United States Patent [19]

Forish et al.

[11] Patent Number: 5,035,643

[45] **Date of Patent: * Jul. 30, 1991**

[54] AXIAL LOW PROFILE LAMP SOCKET ASSEMBLY

[75] Inventors: John A. Forish, Fort Wayne; John J. Rogers, Huntertown, both of Ind.

[73] Assignee: Zanxx, Inc., Avilla, Ind.

[ * ] Notice: The portion of the term of this patent subsequent to Jul. 10, 2007 has been disclaimed.

[21] Appl. No.: 523,018

[22] Filed: May 14, 1990

Related U.S. Application Data

[63] Continuation-in-part of Ser. No. 352,965, May 17, 1989, Pat. No. 4,940,422.

[51] Int. Cl.[5] ..... H01R 33/09

[52] U.S. Cl. ..... 439/358; 439/354; 439/699; 439/918

[58] Field of Search ..... 439/350–358, 439/548, 638, 699, 918, 602, 282, 271–275; 313/318; 29/874, 876, 877, 878, 884

[56] References Cited

U.S. PATENT DOCUMENTS

| | | | |
|---|---|---|---|
| 503,349 | 8/1893 | Lee | 439/271 |
| 2,268,061 | 12/1941 | Richards | 173/352 |
| 3,130,921 | 4/1964 | Morgan | 240/82 |
| 3,143,301 | 8/1964 | Trautner et al. | 240/90 |
| 3,253,249 | 5/1966 | Hess et al. | 439/546 |
| 3,263,204 | 7/1966 | Fitz Gerald | 339/154 |
| 3,559,152 | 1/1971 | Pearce, Jr. | 339/60 |
| 3,676,834 | 7/1972 | Kaldor et al. | 339/59 L |
| 3,781,755 | 12/1973 | Pitacco | 339/14 R |
| 3,781,768 | 12/1973 | Howe | 339/125 L |
| 3,798,588 | 3/1974 | Howe et al. | 339/127 |
| 3,800,267 | 3/1974 | Burgess et al. | 339/14 R |
| 3,805,211 | 4/1974 | Moore | 439/101 |
| 3,810,072 | 5/1974 | Moore | 339/88 R |
| 3,873,176 | 3/1975 | Moore | 339/59 L |
| 3,950,061 | 4/1976 | Kansen | 339/93 L |
| 3,982,813 | 9/1976 | Cope et al. | 330/127 R |
| 3,999,095 | 12/1976 | Pearce, Jr. et al. | 313/318 |
| 4,072,384 | 2/1978 | Moore | 339/59 L |
| 4,100,448 | 7/1978 | Chipner et al. | 313/318 |
| 4,114,972 | 9/1978 | Kraus et al. | 439/375 |
| 4,152,622 | 5/1979 | Fitzgerald | 313/318 |
| 4,301,343 | 11/1981 | Jonelis | 200/283 |
| 4,365,396 | 12/1982 | Baba et al. | 29/25 |
| 4,500,946 | 2/1985 | Mikola | 362/266 |
| 4,573,754 | 3/1986 | Hill | 439/280 |
| 4,588,248 | 5/1986 | Moore | 439/272 |
| 4,630,877 | 12/1986 | Moore | 439/282 |
| 4,631,651 | 12/1986 | Bergin et al. | 362/267 |
| 4,647,132 | 3/1987 | Mikola | 439/345 |
| 4,722,560 | 2/1988 | Guest | 285/323 |
| 4,752,241 | 6/1988 | Matsuoka et al. | 439/619 |
| 4,804,343 | 2/1989 | Reedy | 439/854 |

FOREIGN PATENT DOCUMENTS

| | | |
|---|---|---|
| 2094769 | 2/1972 | France . |
| 1055631 | 7/1967 | United Kingdom . |

*Primary Examiner*—Neil Abrams

*Attorney, Agent, or Firm*—Jeffers, Hoffman & Niewyk

[57] ABSTRACT

A lamp socket assembly including a housing, a contact insert, and a body. The contact insert is captured in a cavity of the housing by the body. The body is welded to the housing. Lugs on the body secure the assembly to a panel. Contacts are retained in the contact insert by engagement of U-shaped portions thereof in slots of the contact insert. Blade terminals are inserted through the contacts and contact insert to interlock the terminals with the contacts and contact insert. The blade terminals include a U-shaped portion whereby the interlocking end of the terminals define one leg of the U-shaped portion. A second end of the blade terminal extends at right angles to the interlocking end of the blade terminal and extends axially away from the body whereby a socket connector may be axially connected to the housing. The socket connector includes locking fingers for securing the socket connector to the housing. The locking fingers include lead-in portions to guide the locking fingers toward projections on the housing which engage the locking fingers.

16 Claims, 13 Drawing Sheets

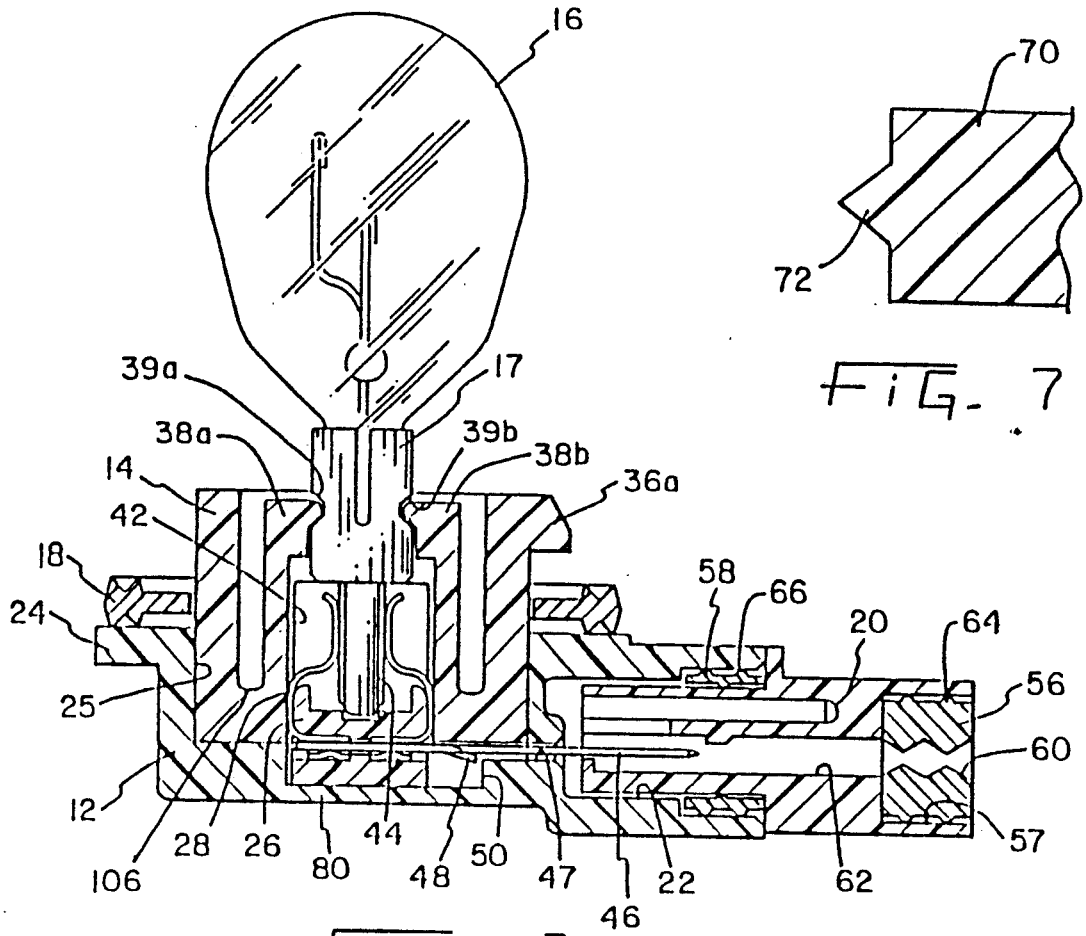
FIG. 3
FIG. 7
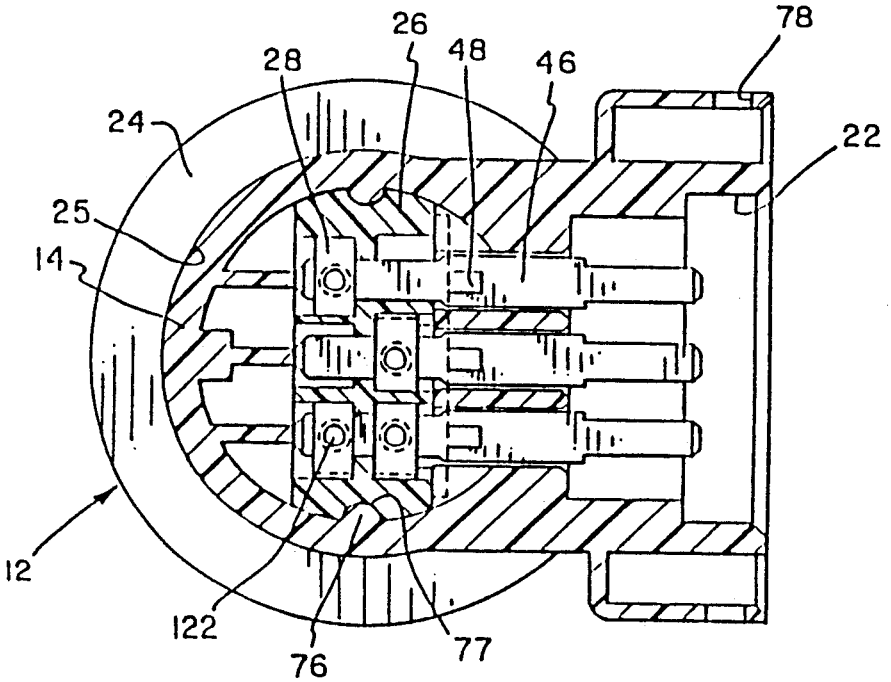
FIG. 4

AXIAL LOW PROFILE LAMP SOCKET ASSEMBLY

RELATED APPLICATION

This application is a continuation in part of application Ser. No. 352,965, filed May 17, 1989 which was issued as U.S. Pat. No. 4,940,422, on July 10, 1990.

BACKGROUND OF THE INVENTION

This invention relates to lamp socket assemblies and in particular to lamp socket assemblies such as are used in tail lights of automobiles and the like. Many designs for such lamp socket assemblies have been provided in the prior art. However, these prior art lamp socket assemblies have had a number of problems associated with them. One problem with such prior art light socket assemblies has been that they are rather complicated and therefore costly to manufacture and assemble. Another problem has been that the electrical contact parts of many such socket assemblies have been subject to corrosion thereby leading to failure of the assemblies. In an effort to provide proper seals for tail light assemblies, some manufacturers have provided large cut-outs in the metal panels of the automobile trunk and have then mounted the tail light lamp socket assemblies on a layup. The entire layup was then secured to the metal panel, such as by screws, with a seal or gasket inserted between the layup and the metal panel. Not only have such lamp assemblies been rather costly to manufacture, but servicing such assemblies, for instance for replacement of burned out bulbs, is quite time consuming and may result in failure to properly install the lamp seal with attendant corrosion problems.

In the use of prior art lamp socket assemblies, the lamp sockets themselves generally extend into the trunk space of the car. This results in several problems. First of all, by extending a substantial distance into the trunk area, the sockets are subject to damage by items stored in the trunk. Some sockets are not adequately secured in place and are easily knocked out of the trunk panel. Furthermore, with the advent of smaller cars, there is a less trunk space available then previously and therefore it is undesirable to have the lamp socket assemblies extend very far into the trunk space.

Some prior art lamp socket assemblies have used a bayonet type of socket which uses a compression spring to ensure proper contact with the bulb. Such sockets are particularly undesirable as the compression spring causes the socket to have a rather high profile which extends a substantial distance into the trunk space. Still other prior art lamp socket assemblies have sought to achieve a low profile by using potted contact structures. These devices are expensive to construct and furthermore are difficult to service.

Still other prior art lamp socket assemblies have been provided wherein the base of the unit is resilient and forms the seal for the assembly. This type of structure is easily over-torqued and damaged when it is installed in an automobile.

Still a further problem with prior art socket assemblies has been that, to achieve a different focal length, an entire new socket assembly had to be constructed. This required substantial investment in tooling and therefore made the socket assemblies rather expensive to manufacture. It is therefore desired to provide a lamp socket assembly which uses a substantial number of common parts to achieve structures having various focal lengths.

In some lamp socket assemblies it is desired to have the terminals for the lamp socket assembly extending at right angles to the axis of the lamp socket. In other lamp socket assemblies it is desired to have the terminals extending axially with respect to the axis of the lamp socket. It is desired to provide a lamp socket assembly which uses a substantial number of common parts to achieve two structures wherein one structure has axially arranged terminals and a second structure which has the terminals arranged at right angles with respect to the axis of the lamp socket.

Some automobile lamp socket assemblies, such as tail light assemblies, comprise a sealed assembly including a housing and lenses for the tail lights. The housing includes apertures for the insertion of socket assemblies, with the bulb of such assemblies inserted into the housing. It is therefore desired to provide a socket assembly for use with such sealed tail light assemblies wherein the socket assembly is sealed to the housing.

It is desired to provide a lamp socket assembly which is simple in construction and which has a low profile. It is furthermore desired to provide a lamp socket assembly which requires only a small cut-out in an automobile panel and which may be sealed to the panel of the automobile without the use of expensive and large gaskets.

Additionally, it is desired to provide a lamp socket assembly which may be used with sealed lamp structures and wherein the socket assembly is sealed to the lamp structure to prevent moisture from entering thereinto.

Still further it is desired to provide a sealed lamp socket assembly which may be used with or without a connector so that a complete light assembly having a number of sockets may use a single connector.

SUMMARY OF THE INVENTION

The present invention overcomes the disadvantages of the above described prior art lamp socket assemblies by providing an improved design therefor. The lamp socket assembly according to the present invention includes a base or housing, a body, and a contact insert into which a plurality of contacts have been inserted. The contact insert is captured in a cavity in the housing by the body. The body is also captured in a cavity of the housing and is then sonic welded to the housing.

The present invention includes a molded housing, body, and contact insert. The housing includes a cavity for receiving the contact insert after electrical contacts have been inserted therein. Prior to placing the contact insert into the housing, terminals are inserted into the contact insert to lock the contacts and contact insert together. The terminals comprise a U-shaped portion having one end thereof adapted to be inserted into the contact insert. A second portion of the terminals extends at right angles to the U-shaped portion. The contact insert is then inserted into the body. The body and contact insert are then inserted into the cavity of the housing whereby the second ends of the terminals extend axially out of the housing. The body captures the contact insert in the housing cavity. The body is then welded to the housing. A flange seal is provided to seal the housing to the metal panel of an automobile. Lugs which are spaced around the body secure the lamp socket assembly to the automobile panel. A socket connector is connected to the housing and is sealed thereto by means of a resilient seal. The socket connector includes locking fingers which contact lock ears on the socket. The locking fingers include lead-in portions which extend at an acute angle to the main portion of the locking fingers. Wires connected to the socket connector are sealed to the socket connector by means of a seal. Thus the entire internal structure to the housing is sealed and therefore protected from moisture and corrosion.

In an alternative embodiment, the present invention comprises a socket assembly without the use of a socket connector. Thus, the electrical wires are directly connected to the blade terminals and the wires are sealed to the housing by means of a wire seal. By means of this arrangement, the number of socket assemblies may be combined to be connected to a source of electrical supply by a single connector. Thus, for instance, a tail light assembly including a plurality of socket assemblies, such as three socket assemblies, may be connected to a source of electric energy by a single socket connector.

One advantage of the present invention is that the lamp socket assembly is completely sealed to the automobile tail light assembly with a resealable seal. Therefore, if a lamp structure is removed, for instance for replacing a bulb therein, the entire socket may be easily resealed simply by installation of the socket assembly.

Another advantage of the present invention is that the lamp socket assembly is easy to install by simply inserting the assembly into a relatively small aperture in the automobile light assembly and by a subsequent twisting movement whereby the camming lugs on the body secure the entire socket assembly to the light assembly.

Yet another advantage of the present invention is that the socket assembly has a low profile whereby it extends only a small distance into the automobile trunk space. Furthermore, the low profile is maintained despite differences in focal length for various lamp socket assembly designs. Thus, only the body of the socket assembly varies in length whereby the lamp socket assembly extends further outside the trunk space but not into the trunk space.

A further advantage of the lamp socket assembly according to the present invention is that the lamp socket is sealed to the light assembly so that the lamp contacts will not corrode.

Yet a further advantage of the present invention is that the lamp bulbs are easy to replace so that the lamp socket is easy to service. The socket merely needs to be removed from the automobile light assembly by a twisting motion, the lamp is pulled out of the socket with a straight pulling motion and a new lamp is inserted. The entire assembly is then reinstalled by extending the lamp through the aperture in the automobile light assembly and by a twisting movement of the socket assembly.

Still another advantage of the present invention is that the lamp socket assembly is not easily damaged because it does not extend very far into the trunk space.

Yet still another advantage of the present invention is that the lamp socket assembly may be so constructed that it is adapted for axial insertion of a socket connector or for the sideways insertion of a socket connector while at the same time each of these connectors uses a substantial number of common parts.

Yet still a further advantage of the present invention is that the socket connector will always positively engage the lamp socket assembly even though the socket connector upon initial insertion into the socket assembly is misaligned. The lead-in offsets of the locking fingers permit positive orientation of the connector while assuring positive contact.

The present invention, in one form thereof, comprises a lamp socket assembly a housing having a first cavity and a body received in the first cavity. The body includes a plurality of camming lugs for retaining lamp socket assembly in a mounted position in an apertured panel. The body further includes a through passage for receiving a lamp base therein and means for retaining the lamp base in the through passage. A contact insert is received in first cavity. The contact insert includes a groove for receiving the lamp base therein. The contact insert includes means for receiving and retaining a contact. A terminal has a first end thereof interlocked with the contact insert and contact and a second end thereof extending out of housing in the axial direction of said passage.

The present invention, in one form thereof, comprises a socket assembly including a housing. The housing includes a first cavity. A body is received in the first cavity and is welded to the housing. The body includes a plurality of camming lugs for retaining the lamp socket assembly in a mounted position in an apertured panel. The body further includes a second cavity for receiving a lamp base therein and means for retaining the lamp base in the second cavity. A contact is received in the body and a terminal has a first end thereof interlocked with the contact. The terminal has a second end thereof extending axially away from the second cavity.

The present invention, in one form thereof, comprises a lamp socket assembly having a housing. The housing includes a first cavity and a projection. A body is received in the first cavity. The body includes a plurality of camming lugs for retaining the lamp socket assembly in a mounted position in an apertured panel. The body further includes a through passage for receiving a lamp base therein and means for retaining the lamp base in the through passage. A contact insert is received in the first cavity. The contact insert includes a groove for receiving the lamp base therein. The contact insert includes means for receiving and retaining a plurality of contacts. A plurality of terminals is interlocked with the contact insert and respective contacts. A socket connector is provided including a locking finger for engaging the projection to lock the socket connector to the housing. The locking finger includes guide means for guiding the finger toward the projection.

It is therefore an object of the present invention to provide a sealed low profile lamp socket assembly which includes resealable seals, which is easy to install, which can accommodate various focal lengths, which may accommodate both axial and transverse socket connectors, which includes a socket connector with locking fingers and lead-in portions therefor, and which extends into the trunk space of an automobile by only a small distance.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 3 is a cross sectional view of the socket assembly of FIG. 1 taken along line 3—3 of FIG. 2;

FIG. 4 is a cross sectional view of the lamp socket assembly of FIG. 1 taken along line 4—4 thereof;

FIG. 7 is an enlarged detailed view of the upper portion of an energy director shown in FIG. 5;

Corresponding reference characters indicate corresponding parts throughout the several views.

The exemplifications set out herein illustrate preferred embodiments of the invention, in one form thereof, and such exemplifications are not to be construed as limiting the scope of the disclosure or the scope of the invention in any manner.

DESCRIPTION OF THE PREFERRED EMBODIMENT

Figure 1:
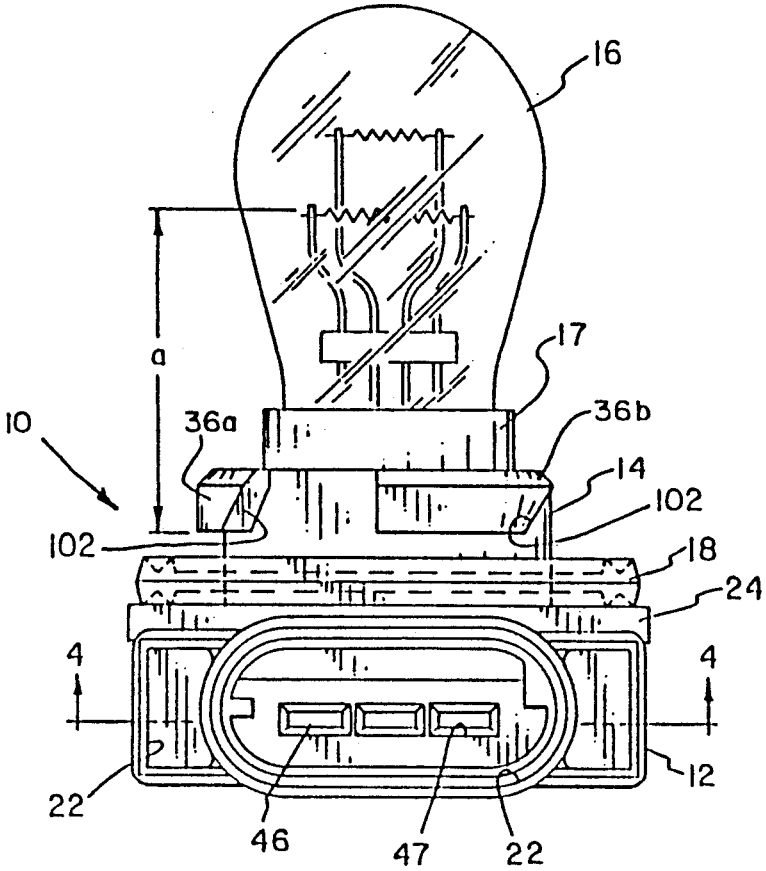
FIG. 1 is a front elevational view of the lamp socket assembly according to the present invention.
Figure 2:
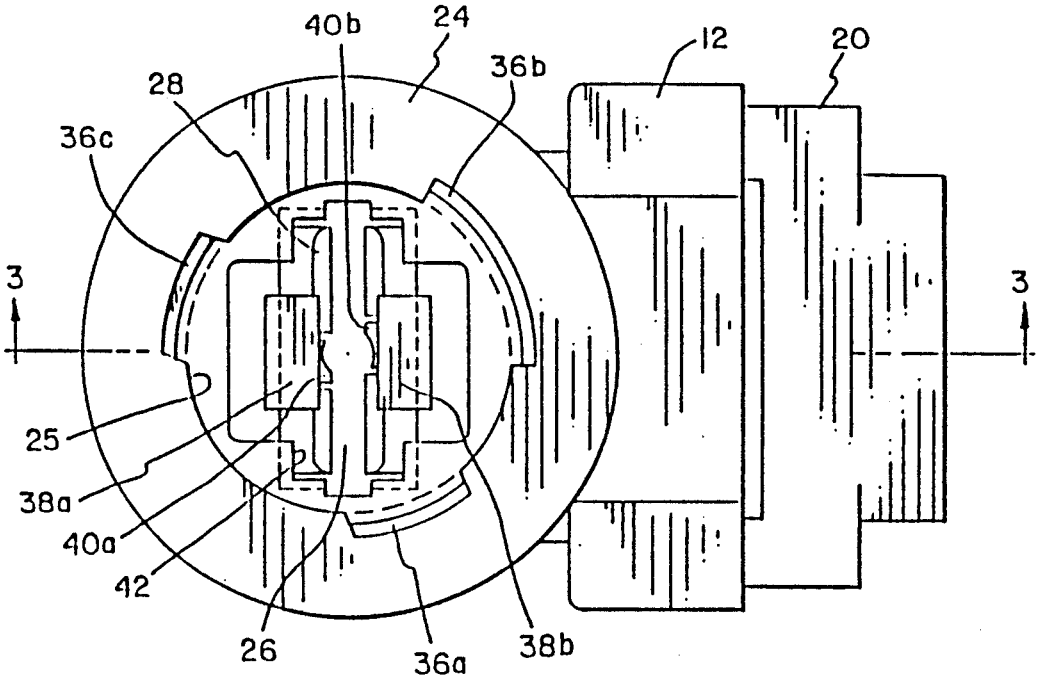
FIG. 2 is a top plan view of the socket assembly of FIG. 1 rotated through 90°.
Figure 5:
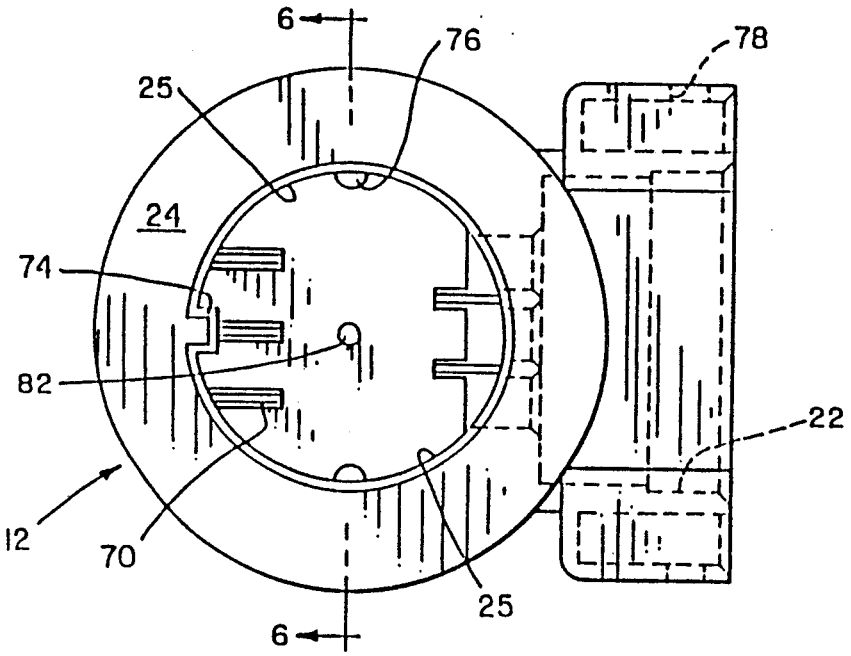
FIG. 5 is a top plan view of the housing for the socket assembly of FIG. 1.
Figure 8:
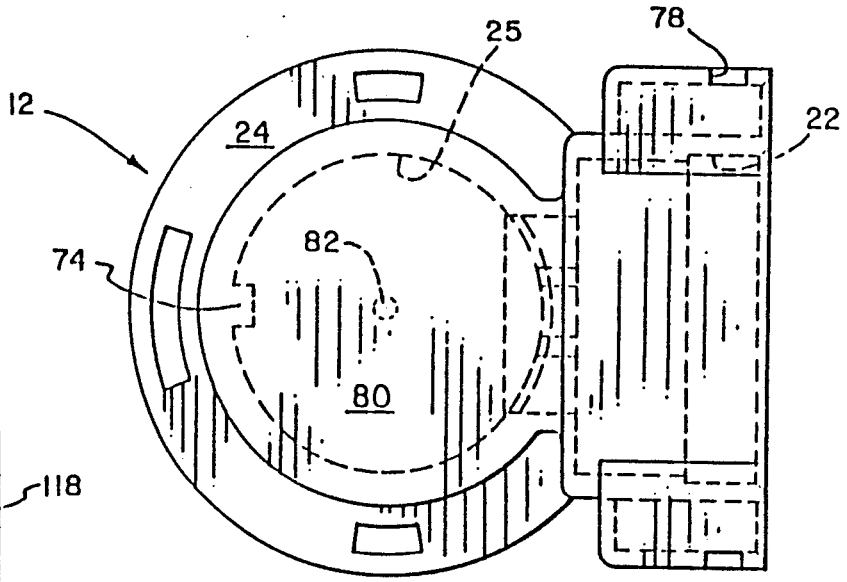
FIG. 8 is a bottom plan view of the housing of FIG. 5.

Referring to FIGS. 1-4 there is shown a preferred embodiment of the lamp socket assembly 10. The assembly includes a base or housing 12, a body 14, and a bulb or lamp 16 shown here as a two-filament lamp. It should be noted that the lamp socket assembly of the present invention can accommodate lamps with various numbers of filaments. The lamp includes a lamp base 17 which is inserted into lamp socket assembly 10. A flange seal 18 is provided for sealing the lamp socket assembly 10 to a panel, such as an automobile panel. A socket connector 20, as best shown in FIGS. 2 and 3, is inserted into a socket 22. Socket connector 20 includes electrical connector terminals (not shown) which are connected to wires (not shown) for connecting the lamp socket assembly to a source of electric power.

It should be noted that, while not illustrated herein, that the socket assembly may be used with a sealed light assembly, such as an automobile tail light assembly. Such assemblies include a lens and a housing wherein the lens is sonically welded to the housing. Thus, moisture cannot enter the assembly except through the access holes into which the socket assemblies are inserted. By providing proper sealing of the socket assembly access holes, such as disclosed for the socket assembly according to the present invention, the entire light assembly is sealed. Thus the lamps or light bulbs will be internal to the light assembly and will be completely sealed as further described hereinafter. It should also be noted that such light assemblies may be used not only for tail lights for automobiles but also for the turning lights, running lights, etc. Furthermore, such assemblies may also be used in other vehicles such as, for instance, boats.

Flange seal 18 is seated on a mounting flange 24 and seals that flange and therefore the entire lamp socket assembly to an automobile panel or automobile tail light assembly.

Base 12 includes a socket cavity 25 in which a contact insert 26 is received. Contact insert 26 includes a plurality of contacts 28. The number of contacts 28 may vary depending upon whether the lamp socket assembly is intended for a single or double filament lamp. Contact insert 26 is captured in socket cavity 25 by means of body 14. Body 14 is sonic welded or secured in some other suitable fashion to base 12 as further described hereinafter.

Body 14 includes locking lugs 36*a*, 38*b*, and 36*c*. The locking lugs 36 are used to lock the entire socket assembly to a panel. Thus the panel would have only a relatively small opening therein including cut-out portions to accommodate locking lugs 36. Each of the locking lugs 36 has a different shape so that the assembly is keyed to the opening in the panel and cannot be inserted incorrectly. The entire lamp socket assembly is thus inserted into the panel aperture and, in the case of an automobile tail light, is inserted with the assembly base 12 extending into the trunk space and with the glass envelope of the lamp 16 extending outside the trunk space into the sealed tail light assembly. Seal 18 provides a moisture barrier for the aperture of the tail light assembly. Lamp 16 is retained in lamp socket assembly 10 by means of retaining fingers 38 which are integrally molded with body 14 and are resiliently hingedly connected to the main part of body 14. Lamp base 17 includes a pair of grooves 39*a* and 39*b*. Retaining fingers 38 which have matching projections thereon for engaging grooves 39*a* and 39*b* retains the lamp 16 securely in the lamp socket assembly.

Thus when the lamp socket assembly 10 is installed in a tail light assembly, the panel would be captured between the bottom surfaces of lugs 36 and the top of flange seal 18. By compressing seal 18 to a predetermined pressure per square inch, the assembly would be properly sealed against moisture.

It should also be noted that by changing the portion of body 14 which extends upwardly from lugs 36, as shown in FIG. 1, the focal length of the lamp socket assembly can be varied. The focal length is the distance "a", shown in FIG. 1, between the bottom of lugs 36 and the location of the lamp filament. Thus one advantage of the instant lamp socket design is that, by simply changing the length of the body 14 and the length of the contact insert 26, the focal length of the entire assembly can be varied while retaining the same base 12.

Body 14 includes a through passage 42 into which the lamp base 17 and the contact insert 26 is received. It can be seen in FIG. 2 that contact insert 26 includes a pair of contact insert posts 40, as further described hereinafter, between which lamp base 17 is received. Lamp base 17 includes contact wires 44 for contacting electrical contacts 28 to provide electric power to the lamp filaments. Blade terminals 46 in turn contact electrical contacts 28 as further explained hereinafter to provide the electrical connection between the wires leading up to the socket and contacts 28. Blade terminals 46 are captured in socket cavity 25 by means of struck out tabs 48 in the blade terminals and shoulder 50 in cavity 25 of housing 12. Thus, once the blade terminals 46 have been inserted into the assembly and capture contacts 28 therein, as explained hereinafter, the blade terminals 46 cannot be retracted or pulled out.

The entire assembly includes further seals for preventing moisture from reaching the interior of socket cavity 25 and possibly corroding the electrical contacts. Thus, as best seen in FIG. 3, wire seal 56 is provided in a cavity 57 of socket connector 20. The wire seal includes a plurality of wire apertures through which the individual wires (not shown) extend. Seal 56 also includes ribs 64 to provide a positive moisture seal. Thus no moisture can leak into the socket cavity past the connecting wires. A ring seal 58 is provided around socket connector 20 to seal the socket connector 20 in socket 22 of base 12. It should be noted that ribs 66 are provided to insure a positive seal. Socket wire seal 56 and ring seal 58 are preferably manufactured of a resilient and flexible material such as, for instance, silicone rubber. Similarly, flange seal 18 is preferably manufactured of a resilient and flexible material such as silicone. By means of the three seals 18, 56, and 58, the interior of cavity 25 is sealed against moisture and no moisture will be able to enter socket cavity 25 from the automobile trunk space.

Referring now to FIGS. 5–8, the base or housing 12 of the socket assembly is shown. In particular, by referring to FIG. 5, it can be seen that a plurality of energy directors or ribs are provided on the bottom surface of the socket cavity 25. By referring to the detailed partial view of FIG. 7, it can be seen that triangular portions 72 are provided on the top surfaces of the energy directors 70. Energy directors 70 are used for welding the body 14 to base 12 by means of sonic welding. The provision of the energy directors 70 ensures secure attachment of the body and base.

Figure 6:
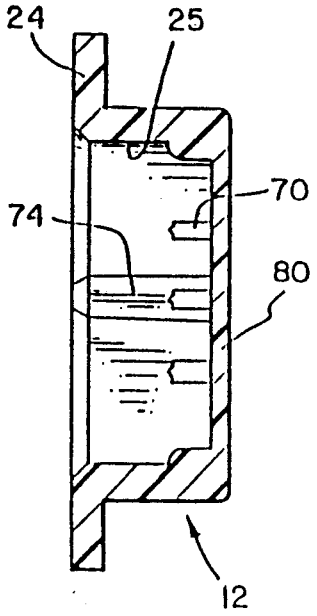
FIG. 6 is a cross sectional view of the housing of FIG. 5 taken along line 6—6 thereof.

It should be noted, by reference to FIG. 3, that energy directors 70 extend axially upwardly in cavity 25 from the bottom wall 80 of the cavity. The number of energy directors 70, their height and thickness as seen in FIG. 6, and their spacing is critical.

As further illustrated in FIG. 1, the space between the bottom surface of lugs 36 and the top surface of mounting flange 24 must be closely held during the assembly of body 14 to housing 12 in order to achieve the proper compression of seal 18 in the mounting of lamp socket assembly in a panel (not shown). By selecting the proper height, thickness, spacing and number of energy directors, this space for accommodating the panel thickness can be closely held.

Base 12 also includes a key 74 which is used for properly orienting body 14 with regard to base 12. Two contact insert keys 76 are also provided in cavity 25 along with a locating projection 82 to properly locate contact insert 26 in cavity 25. Socket 22 includes a pair of windows or apertures 78 for securement therein of a pair of fingers (not shown) which are part of socket connector 20 and which lock socket connector 20 to housing 12.

Referring now to FIGS. 10–14, body 14 is shown. The body includes a through aperture or passage 42 and a pair of ribs 90 therein. These ribs guide lamp base 17 when it is inserted into the through passage 42. Retaining fingers 38 are molded integrally with body 14 and are hinged at 106. Fingers 38 are therefore resiliently connected and are biased inwardly into through passage 42 so that they firmly grasp a lamp base 17. The fingers can move outwardly into spaces 92 located directly behind fingers 38. A key slot 94 is provided in body 14 to cooperate with key 74 in socket cavity 25 to properly orient body 14 during assembly thereof to base 12. A further slot 96 is provided in the lower portion of body 14 for accommodating contact insert 26 during assembly thereof to base 12 and body 14. One or more ribs 98 are provided on the bottom of body 14 for cooperating with energy directors 70 and for welding body 14 to base 12. Some of the energy directors 70 also contact bottom surface 100 of body 14 for securement thereto by means of sonic welding.

Figure 12:
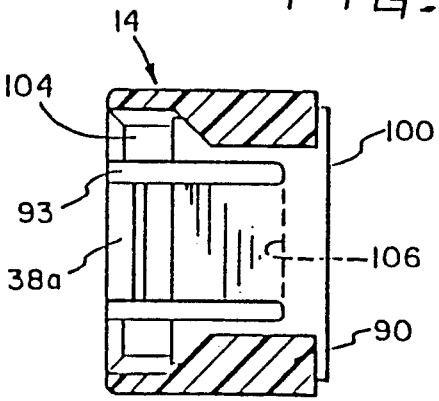
FIG. 12 is a sectional view of the body of FIG. 10 taken along line 12—12 thereof.
Figure 13:
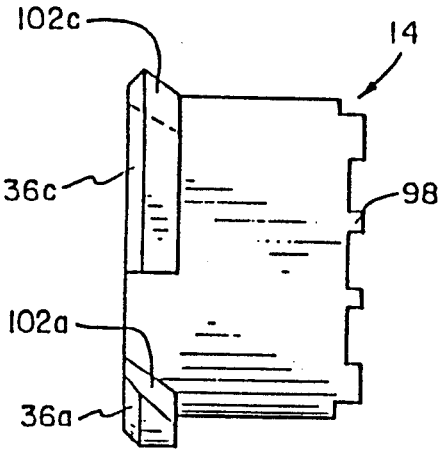
FIG. 13 is a side view of the body of FIG. 10 taken from the right hand side thereof.
Figure 14:
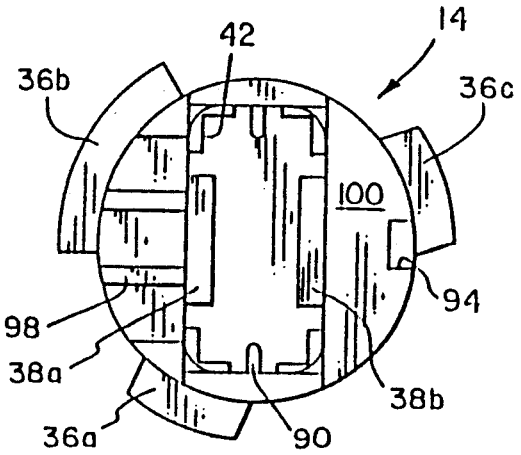
FIG. 14 is a bottom plan view of the body of FIG. 10.

By referring to FIGS. 1 and 12, it can be seen that lugs 36 include camming surfaces 102. Camming surfaces 102 enable the lamp socket assembly to be properly assembled to an automobile panel or tail light housing by camming over the surface of the automobile panel or tail light housing to provide sufficient pressure between flange seal 18 and the panel or housing to form a proper seal. Lastly, shoulders 104 are provided in through passage 42 to accommodate and guide a lamp base 17 during its insertion thereof into through passage 42.

Base 12, body 14, and contact insert 26 and socket 20 may all be molded from a suitable insulating material such as, for instance, nylon which may be glass filled. This material is sufficiently rigid so that it cooperates properly with flexible resilient seals 18, 56, and 58 to properly seal the structure against moisture as described hereinabove.

Turning now to FIGS. 15–18, electrical contacts 28 for the lamp socket assembly 10 are illustrated. The contacts are constructed of a suitable conductive material, such as brass. The contacts include U-shaped bent portions 114 which have a window 116 therein for insertion of blade terminals 46 therethrough as shown in FIGS. 3 and 4. The contacts 28 include a contacting portion 118 and a bent portion 119 for contacting lamp contact wires 44. U-shaped bent portion 114 includes a bottom leg 124 and an upper leg 126. Upper leg 126 includes a struck out protrusion 122 for providing proper contact with blade terminal 46 during insertion thereof into the assembly.

Figure 18:
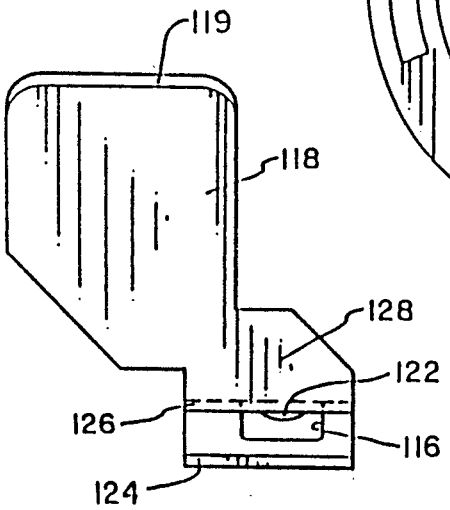
FIG. 18 is a side elevational view of another terminal for the socket assembly of FIG. 1.
Figure 15:
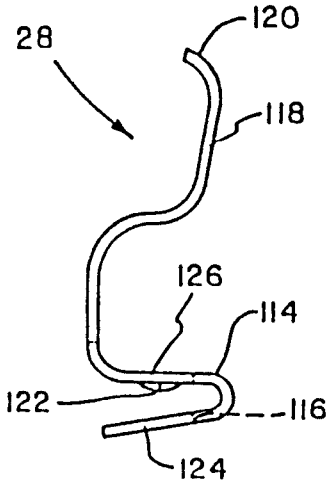
FIG. 15 is a front elevational view of a terminal for the lamp socket assembly of FIG. 1.
Figure 16:
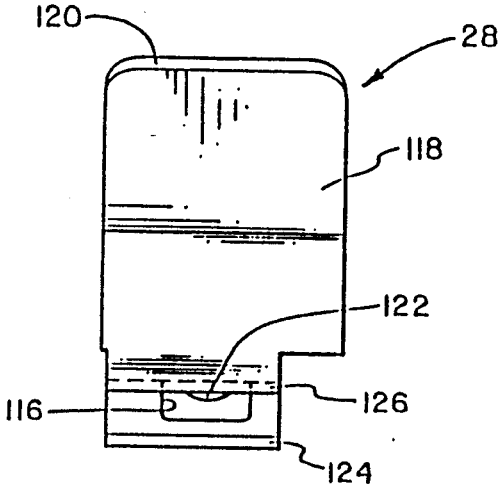
FIG. 16 is a side elevational view of the terminal of FIG. 15 taken from the left hand side thereof.
Figure 17:
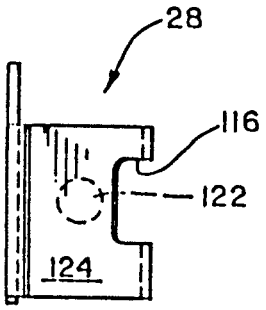
FIG. 17 is a bottom plan view of the terminals of FIG. 15.

FIGS. 15, 16, and 17 show a terminal for the assembly. FIG. 18 shows a ground terminal for the assembly. The ground terminal has an offset portion 128 whereby the terminal may be inserted into the contact insert in one lateral location whereas the main body of the terminal is offset from that location for proper contact.

Figure 19:
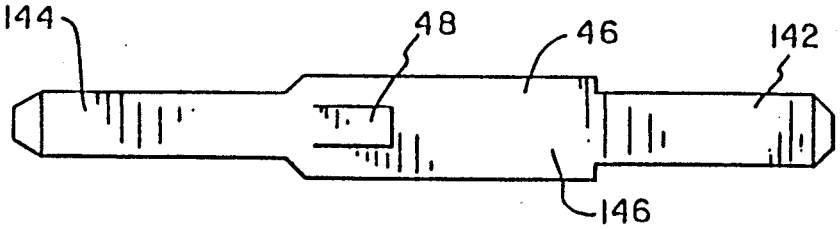
FIG. 19 is a front elevational view of a blade terminal for the socket assembly of FIG. 1.
Figure 20:
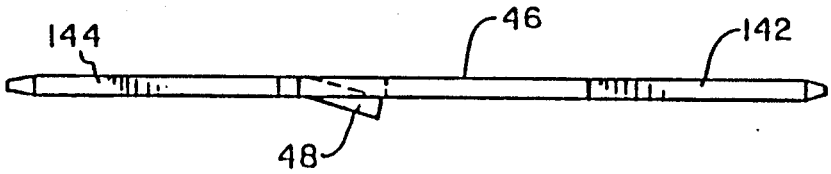
FIG. 20 is a side elevational view of the blade terminal of FIG. 19.
Figure 21:
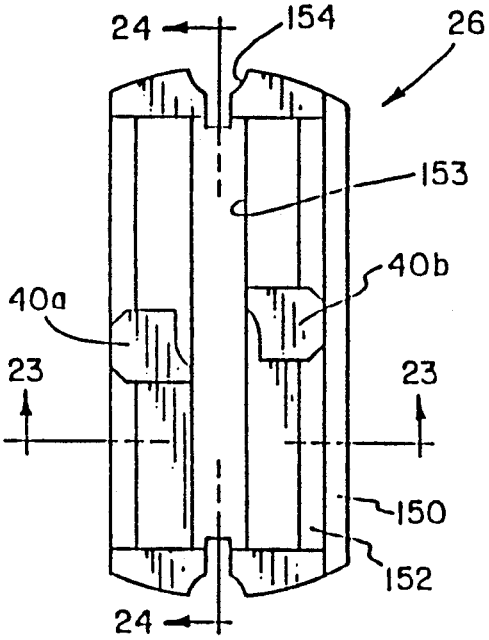
FIG. 21 is a top plan view of a contact insert for the socket assembly of FIG. 1.
Figure 22:
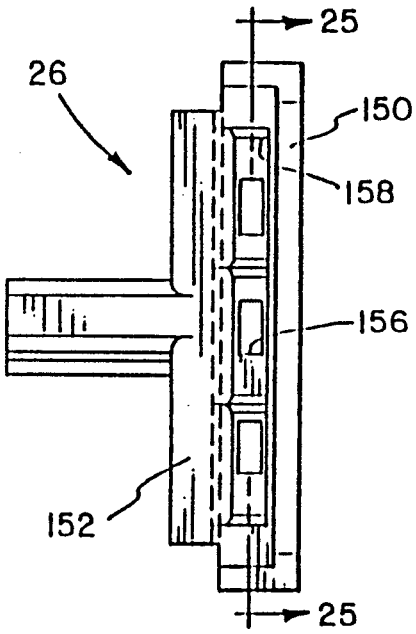
FIG. 22 is a side elevational view of the contact insert of FIG. 1.
Figure 23:
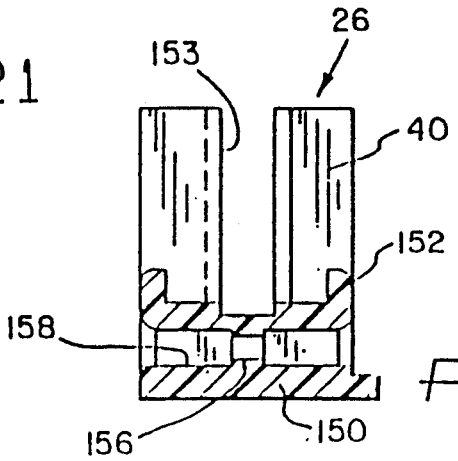
FIG. 23 is a cross sectional view of the contact insert of FIG. 21 taken along line 23—23 thereof.
Figure 24:
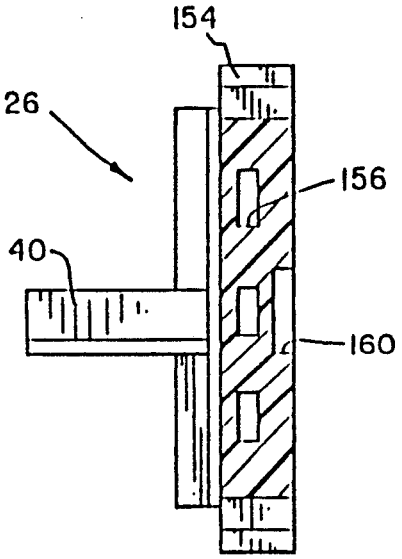
FIG. 24 is a cross sectional view of the contact insert of FIG. 21 taken along line 24—24 thereof.
Figure 25:
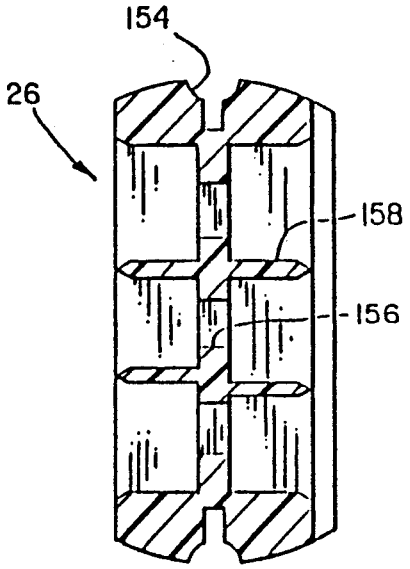
FIG. 25 is a cross sectional view of the contact insert of FIG. 21 taken along line 25—25 of FIG. 22.

FIGS. 19 and 20 show a blade terminal. Blade terminal 46 is a planar terminal having two end portions 142, 144 which are somewhat thinner than central portion 146. Central portion 146 includes a struck out tab 48 for preventing blade terminal 46 from being pulled out of the socket assembly once it has been assembled thereinto. End portion 144 is inserted into the base 12 through a window 116 of a contact 28 as further explained hereinafter. End portion 142 extends into socket 22 for contacting a terminal (not shown) in socket connector 20.

FIGS. 21–25 show a contact insert 26. Contact insert 26 includes a base 150 which is generally planar. A pair of walls 152 are integrally formed with base 150 and extend upwardly therefrom to form a groove 153 therebetween. Key slots 154 are provided at either end of base 150 for cooperating with keys 76 in socket cavity 25 of base 12 for properly orienting the contact insert 26 during assembly thereof to base 12. Additionally a key aperture 160 is provided centrally of base 150 for proper orientation of the contact insert 26 during assembly thereof to base 12. Base 150 includes a plurality of windows 156 and slots 158 for accommodating contacts 28 and blade terminals 46. Posts 40 are formed integrally with and extend upwardly from base 50 for properly guiding a lamp base 17 into groove 153.

Figure 26:
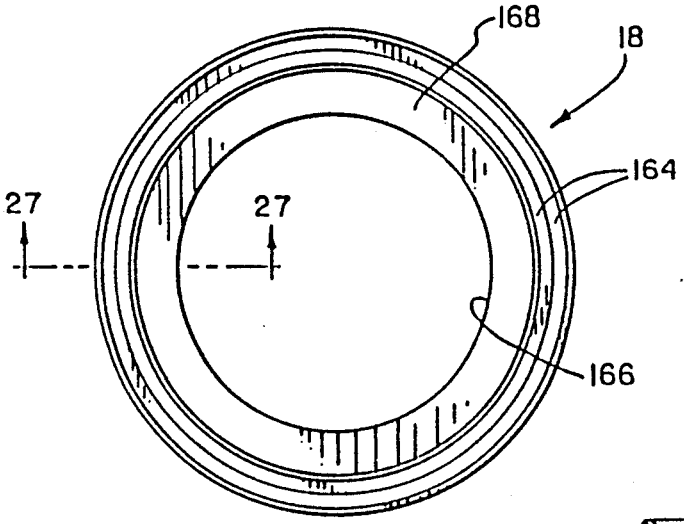
FIG. 26 is a top plan view of a flange seal for the socket assembly of FIG. 1.
Figure 27:
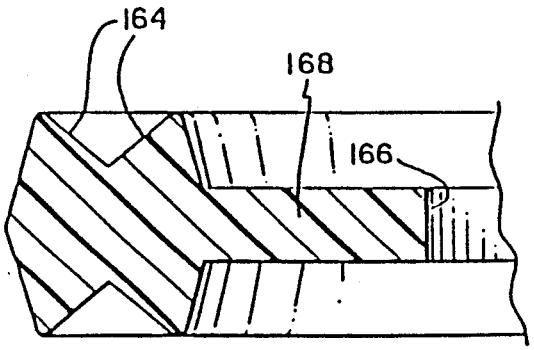
FIG. 27 is an enlarged cross sectional view of the flange seal of FIG. 26 taken along line 27—27 thereof.

FIGS. 26 and 27 show the flange seal 18. The flange seal comprises a flange 168 with a pair of upstanding ribs 164 at the outer perimeter thereof. An aperture 166 is provided in the flange seal for accommodating body 14.

Referring now to FIGS. 1–3, the lamp socket assembly is assembled as follows. Molded contact insert 26 is first assembled with a set of contacts 28. The U-shaped bent portion 114 of each contact is inserted into the appropriate slot 158 of base 150 of the contact insert with the rounded portion 118 of the contact facing groove 153. Since the material from which the contacts 28 are made is somewhat resilient, the contacts are resiliently retained in slots 158. Contact insert 26 is then inserted into cavity 25 of base 12. Because of the location of keys 76 and 82, improper assembly of the contact insert 26 in base 12 is prevented. Body 14 is now inserted into socket cavity 25 and is properly oriented therein by means of key 74 and key slot 94. Body 14 captures contact insert 26 in cavity 25 by engagement of contact insert base 50 in contact insert slot 96 of body 14. Thus the contact insert is properly captured and is immovably fixed in socket cavity 25. The assembly is now subjected to sonic welding or another suitable welding technique which is applied to bottom 80 of base 12. Sonic welding is a well known process and therefore need not be explained further herein. The provision of energy directors 70 with upstanding triangular ribs 72 thereon provides proper guidance to the energy applied by the sonic welding process to provide melting of portions 72 and securement of body 14 to base or housing 12. If sonic welding is used, as explained hereinbefore, the thickness and height of the energy directors 70 is critical for the particular spacing and number of energy directors shown. The energy directors are axially oriented with respect to the cavity 25 and body 14. Thus as the body and housing are welded together, the energy directors will melt and the body 14 will enter the cavity 25 further. Sonic welding will be stopped when the distance between the bottom surface of lugs 36 and the top surface of mounting flange 24 is within prescribed limits. By proper design of axial energy directors 70, the strength and uniformity of the sonic weld will be within acceptable tolerances.

An appropriate number of blade terminals 46 are now inserted through windows 47 of base 12, windows 156 of contact insert 26 and windows 116 of contacts 28, thereby capturing the contacts 28 firmly in contact insert 26 and the contact insert in base 12. Blade terminals 46 are retained in the assembly by means of tabs 48 which interlock with blade retaining shoulder 50 of base 12. A socket insert 20 is now provided with seals 56 and 58 and with appropriate wires and contact terminals (not shown). Socket 20 is inserted into socket 22 to complete the assembly. It can thus be seen that the entire assembly is extremely simple and forms a sealed structure to prevent contamination and corrosion of the electrical contacts by moisture. Furthermore, it can be seen that the portion of the socket assembly extending into the trunk space of an automobile, namely base or housing 12, is very small indeed. The typical extension of the base 12 into the trunk area is ½" or less.

Figure 9:
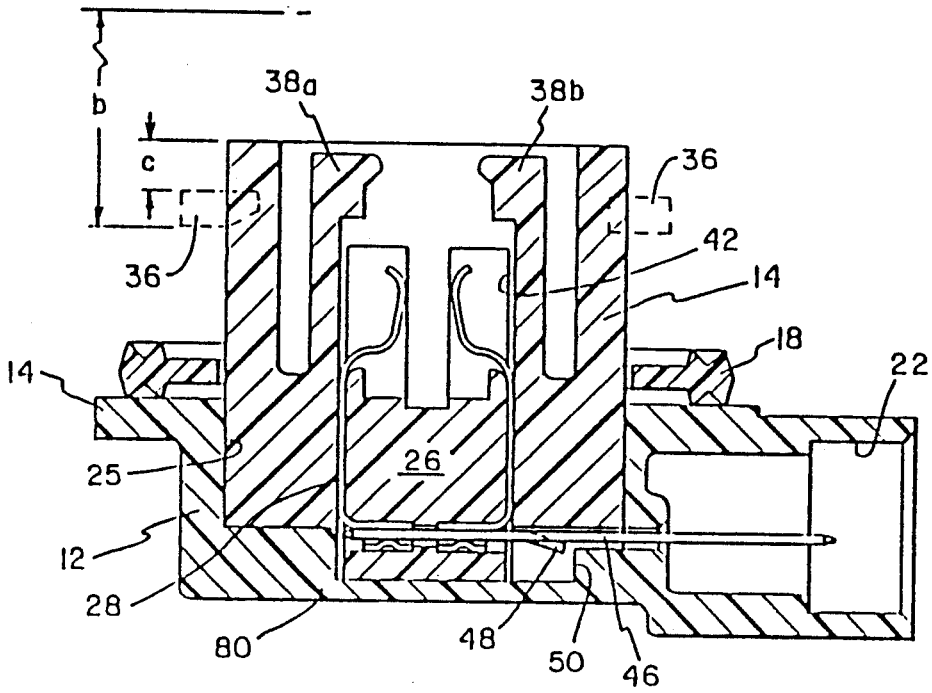
FIG. 9 is a cross sectional view of an embodiment of a socket assembly according to the present invention with a different focal length.
Figure 10:
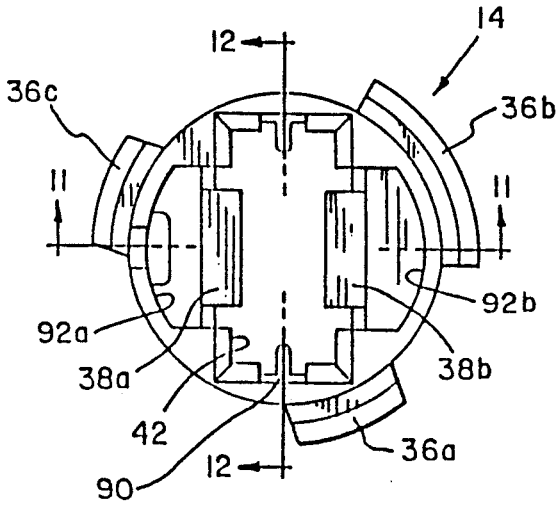
FIG. 10 is a top plan view of a body for the socket assembly of FIG. 1.
Figure 11:
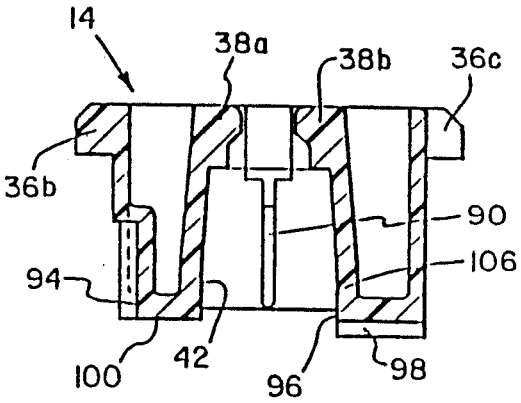
FIG. 11 is a section of the body of FIG. 10 taken along line 11—11 thereof.

Referring now to FIG. 9, it can be seen that various assemblies with different focal lengths may be provided utilizing the same basic socket assembly design. By referring to the focal length "a" of FIG. 1 and comparing this to the focal length "b" of FIG. 9, it can be seen that they are different. The focal length is defined as the distance from the bottom of lugs 36 to the filament location. The body 14 of the assembly of FIG. 9 has a higher extension "c" extending beyond the top surface of lugs 36 (schematically illustrated) than the body 14 illustrated in FIG. 1. Therefore the focal length of the assembly of FIG. 9 is different and longer than the focal length of the assembly of FIG. 1. By varying the distance "c", the focal length of the structure can be changed in a very simple manner. Base 12 of the assembly FIG. 9 is identical to the base 12 of the assembly of FIG. 1. Thus, the longer focal length of the assembly of FIG. 9 is accompanied by an identical extension of base 12 into the trunk space of the automobile. The assembly of FIG. 9 also utilizes a different contact insert 26 and contacts 28 than the assembly of FIG. 1 in order for the lamp base 17 to be able to reach contacts 28. The contacts 28 of FIG. 9 also have longer extensions as can be seen by comparing the contacts 28 of FIGS. 3 and 9. Thus, it can be seen that the structure can be adjusted for a variety of focal lengths by the simple provision of a different body 14, contact insert 26, and contacts 28. The extension of the assembly into the usable trunk space remains the same.

Figure 28:
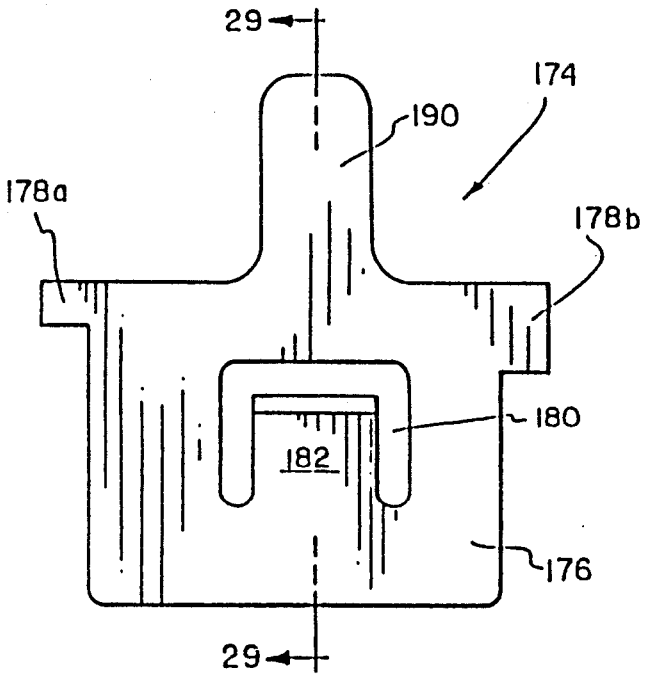
FIG. 28 is a top plan view of a locking wedge for use with an alternative embodiment of the lamp socket assembly according to the present invention.
Figure 29:
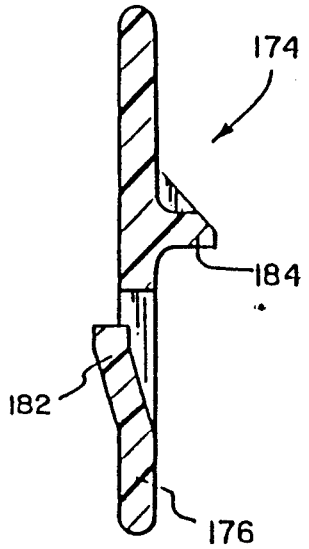
FIG. 29 is a side elevational view of the locking wedge of FIG. 28.
Figure 30:
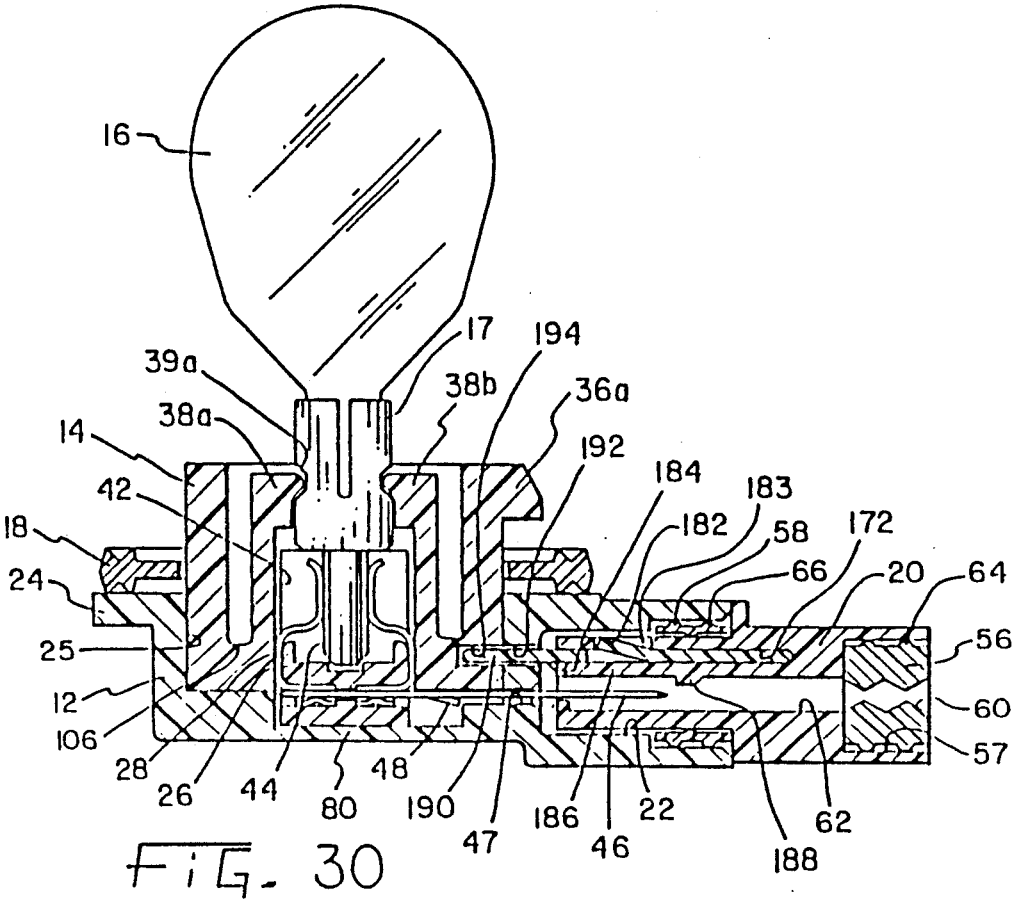
FIG. 30 is a cross sectional view of an alternative embodiment of a socket assembly including the locking wedge of FIG. 28.

Referring now to FIGS. 28-30, there is shown a further embodiment of the present invention including a locking wedge which locks together base 12 and body 14. The locking wedge is inserted into a slot 172 of the socket connector 20. The locking wedge includes a planar tab portion 176 having a pair of shoulders **178*a* and 178*b* which are keyed with respect to slot 172 so that the locking wedge can only be inserted in a desired orientation. Tab 176 includes a U-shaped slot 180 which forms a wedge locking tab 182 and which is so molded as to extend resiliently upwardly as shown in FIG. 30. Thus, wedge locking tab 182, upon insertion of locking wedge 174 into slot 172, will snap into space 183 to prevent the locking wedge from being pulled out of connector 20. Stops 184 abut against connector 20 to prevent locking wedge 174 from being inserted too far into slot 172. The purpose of the locking wedge is to prevent the resilient fingers 186 of connector 20 from being displaced upwardly and to ensure that locking tabs 188 of fingers 186 will engage with the connectors (not shown) to provide proper contact thereof with blade terminals 46**.

Locking wedge 174 also includes a snout or protrusion 190 which, upon insertion of connector 20 into socket 22, will be inserted into aperture 192 of housing 12 and aperture 194 of body 14. Apertures 192 and 194 are aligned whereby snout 190 may be simultaneously inserted thereinto.

Snout 190 ensures that body 14 will be locked in place, even if the weld which secures body 14 to housing 12 should fail. Thus, upon insertion of the socket connector 20, the entire socket assembly is locked together.

While the protrusion 190 is located on the locking wedge it should be noted that it could be placed elsewhere on the socket connector.

Figure 31:
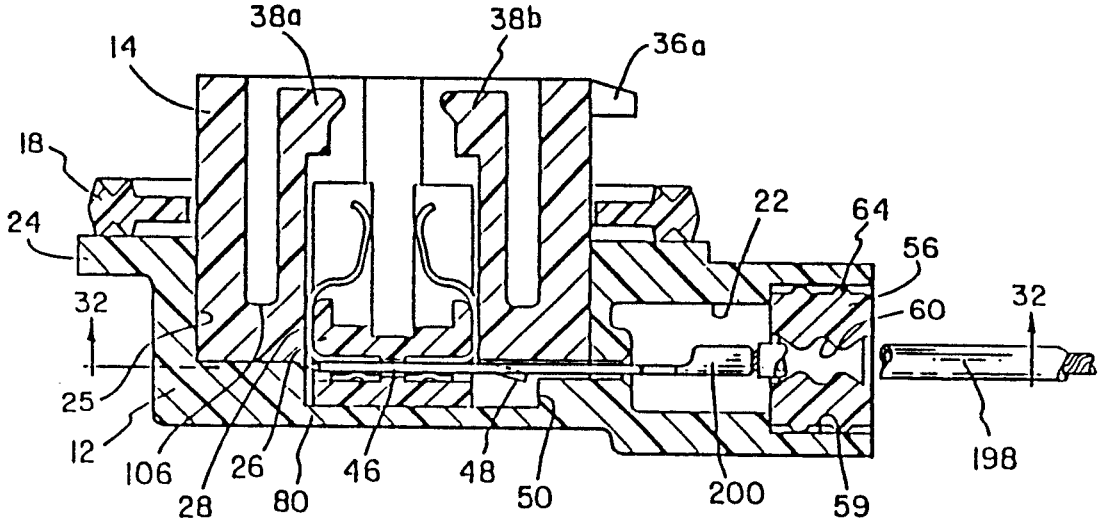
FIG. 31 is a cross sectional view of a connectorless alternative embodiment of a socket assembly according to the present invention.
Figure 32:
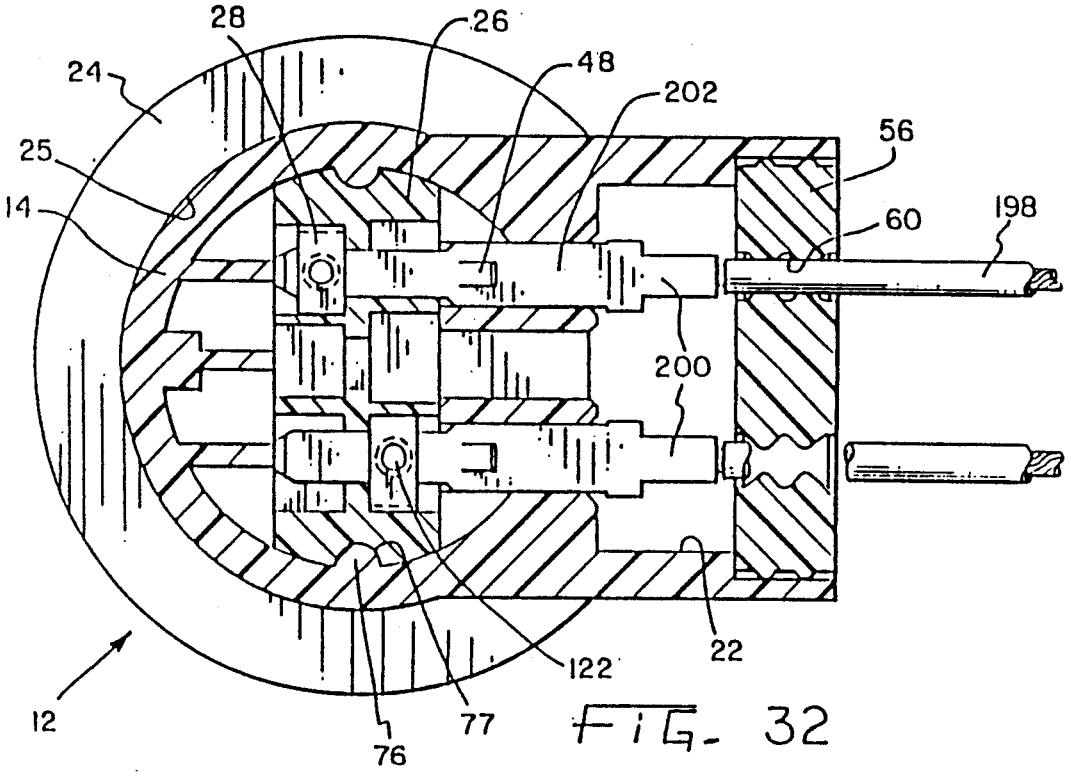
FIG. 32 is a cross sectional view of the socket assembly of FIG. 31 along line 32—32 of FIG. 31.

Referring now to FIGS. 31 and 32, there is shown an alternative embodiment of the invention. These figures disclose a connectorless socket assembly. Instead of the use of a socket connector including contacts for connecting with blade terminals 46, this embodiment does not use a socket connector. Rather, wires 198 are directly crimped to blade terminals 202 by means of crimps 200. Alternatively, wires 198 could be soldered to the blade terminals 202. The wires are sealed in socket 22 of housing 12 by means of a wire seal 56 as described hereinabove. In the assembly of this embodiment, the blade terminals are crimped to wires 198, a seal 56 is then slipped over the blade terminals and wires 198, the blade terminals 202 are then inserted into the socket assembly and the seal is placed into socket 22 to seal the wires 198. Thus, in this particular version, a connector would be placed downstream of wires 198. Further, several socket assemblies could be connected to a single connector. For instance, in a tail light assembly of an automobile, several socket assemblies such as, for instance, three, might be used whereas a single connector would be used to connect three socket assemblies to the wiring harness of the automobile.

Figure 33:
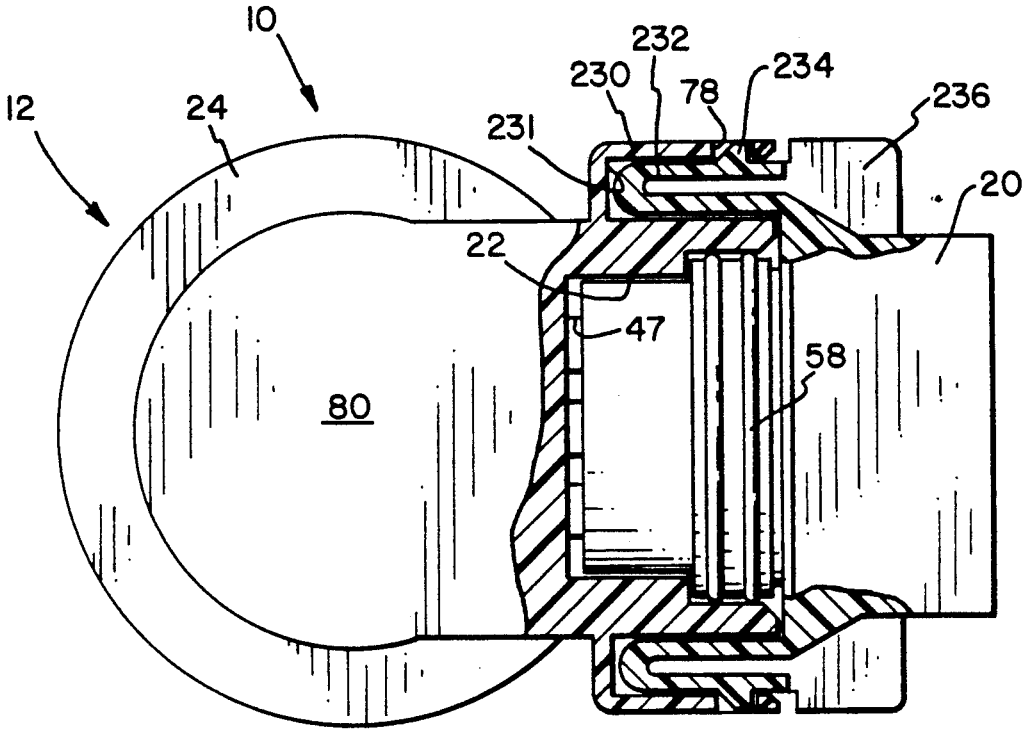
FIG. 33 is a bottom plan view of the lamp socket assembly of FIG. 4.
Figure 34:
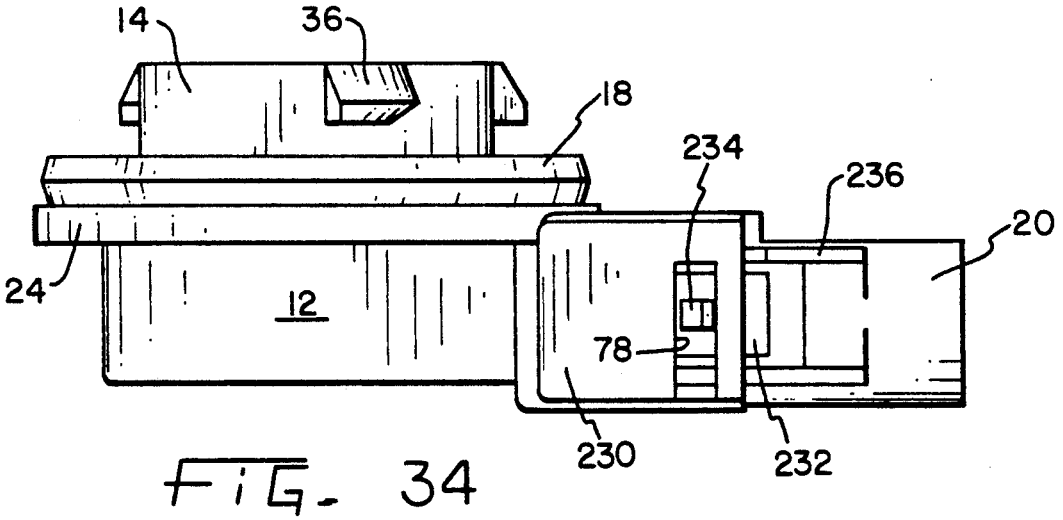
FIG. 34 is a side elevational view of the lamp socket assembly of FIG. 4.

Referring now to FIGS. 33 and 34, the socket connector 20 for lamp socket assembly 10 is shown in greater detail. Shoulders 230 of base 12 form openings 231 which accommodate spring fingers 232. Spring fingers 232 form part of socket 20 and include lugs 234 which snap into place in socket retaining apertures 78 of the extensions of shoulders 230. During the assembly of socket connector 20 to base 12, ring seal 58 is also moved into place to seal connector 20 to base 12. Flanges 236 are provided on socket connector 20 for protection of spring fingers 232.

The embodiments shown in FIGS. 1-34 all show a socket connector 20 which connects at right angles to the axis of housing 12 rather than axially in the axial direction of lamp 16 and body 14. The embodiment shown in FIGS. 35-43 discloses an axial lamp socket assembly wherein the socket connector is oriented axially with respect to the axis of lamp 16 and body 14. It should be noted that many of the parts for constructing the lamp socket assembly embodiments shown in FIGS. 1-34 are common to the lamp socket assembly embodiment shown in FIGS. 35-43.

Referring now to FIGS. 35-43, there is shown an axial socket connector assembly wherein the socket connector is also a different embodiment than the socket connector for the embodiments shown in FIGS. 1-34.

Figure 35:
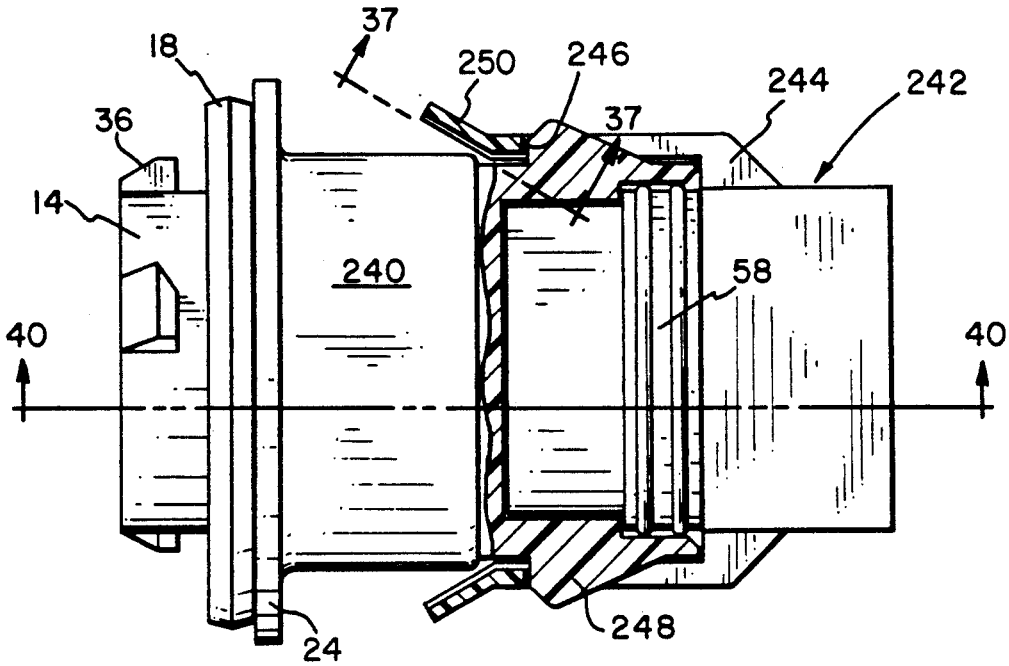
FIG. 35 is a bottom plan view, partially in cross section, of an axial embodiment of the lamp socket assembly according to the present invention.
Figure 36:
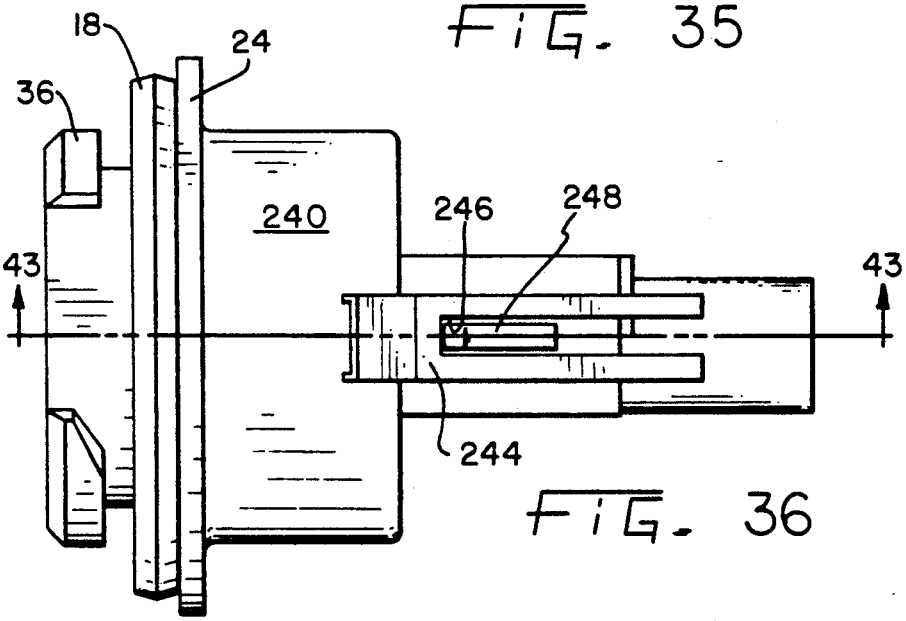
FIG. 36 is a side elevational view of the lamp socket assembly of FIG. 35.

FIGS. 35 and 36 disclose a socket connector 242 secured to housing 240. Assembled to housing 240 are body 14 having locking lugs 36 and flange seal 18. Flange seal 18 seats on flange 24 similarly as explained in connection with FIGS. 1-34.

Figure 37:
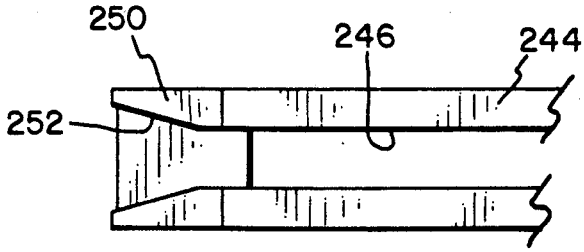
FIG. 37 is a partial enlarged view of a locking finger for the socket connector of the lamp socket assembly of FIG. 35.

Housing 240 includes lugs 248 which are received in slots 246 of locking fingers 244 of socket connector 242. As shown in FIG. 37, flanges 250 of locking fingers 244 each include a lead-in groove 252 for receiving lug 248 when the socket connector is assembled to housing 240. Thus, even if the lugs 248 are not properly aligned with slots 246 during the assembly of socket connector 242 to housing 240, lead-in grooves 252 guide the lugs 248 into slots 246. Fingers 244 are resilient so that, by spreading fingers 244 apart the socket connector can be disassembled from housing 240.

Figure 38:
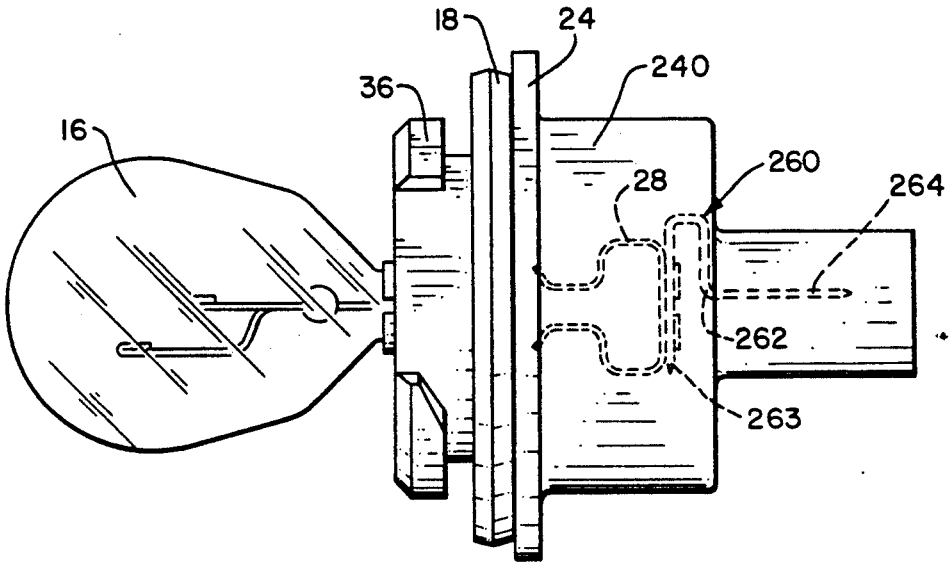
FIG. 38 is a side elevational view of the lamp socket assembly of FIG. 35 with the contacts and terminals shown in phantom lines.
Figure 39:
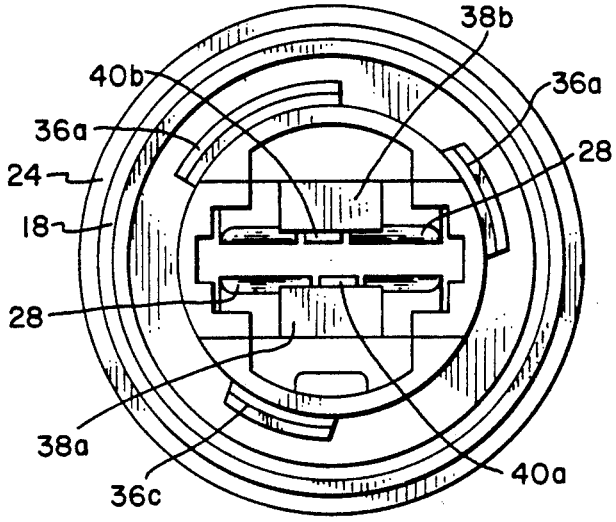
FIG. 39 is a top plan view of the lamp socket assembly of FIG. 35.
Figure 40:
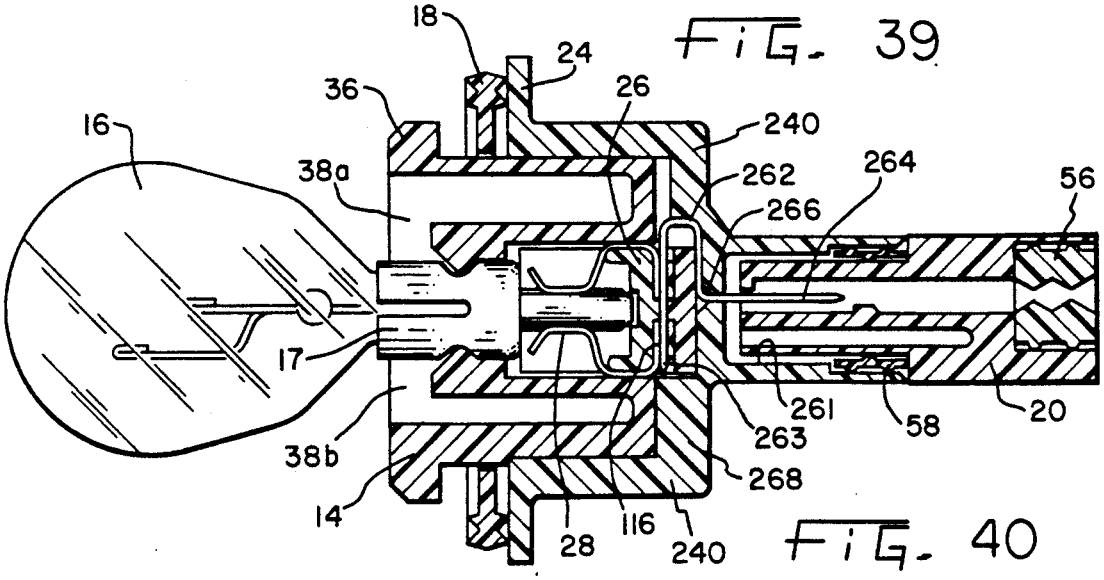
FIG. 40 is a cross sectional view of the lamp socket assembly of FIG. 35 taken along line 40—40 thereof.
Figure 41:
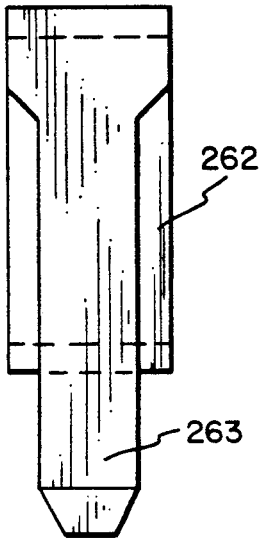
FIG. 41 is an end view of a terminal for the lamp socket assembly of FIG. 35.
Figure 42:
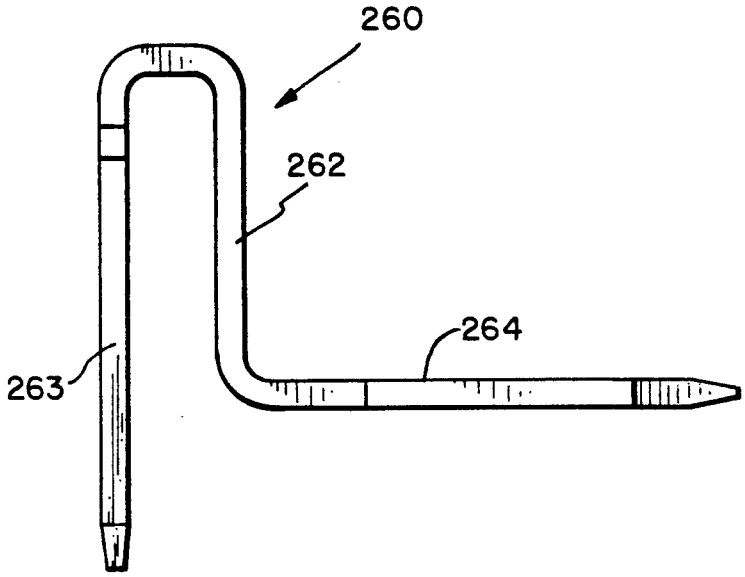
FIG. 42 is a side elevational view of the terminal of FIG. 41.
Figure 43:
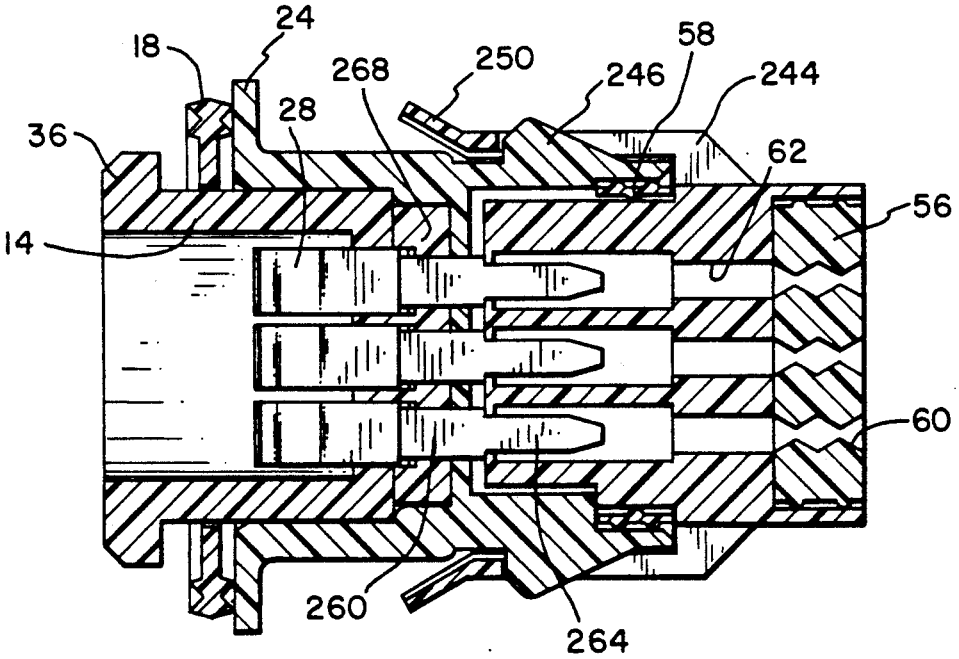
FIG. 43 is a cross sectional view of the lamp socket assembly of FIG. 36 taken along line 43—43 thereof.

Referring now to FIGS. 38-43, the terminal structure for the axial lamp socket assembly is shown. In FIG. 38 contacts 28 are shown in phantom lines as are terminals 260. As best seen in FIGS. 41 and 42, the terminal includes a U-shaped portion 262 with one leg thereof indicated at 263 for defining an end of terminal 260. The other end 264 of terminal 260 extends at right angles to U-shaped portion 262. As best seen in FIG. 40, end 264 extends into aperture 261 of housing 240 which receives socket connector 20. End 263 is inserted through windows 156 of contact insert 26 and windows 116 of contacts 28. Thus, blade terminal 260 interlocks contacts 28 with contact insert 26. In this assembly it should also be noted that windows 266 are provided in bottom 268 of housing 240 for accommodating ends 264 of terminal 260. FIG. 43 shows a cross sectional view with three blade terminals 260 with their ends 264 in assembled condition.

In the assembly of the axial connector, contacts 28 are first assembled into contact insert 26. Blade terminals are then used to interlock the contacts to the contact insert as explained hereinabove. Contact insert 26 is then inserted into housing 240 with ends 264 of terminals 260 extending through windows 266 in housing 240. Body 14 is assembled into housing 240 to retain contact insert 26 in place. Body 14 is then sonic welded to bottom 268 as described hereinabove. Thus, the entire socket assembly is rigid and interlocked so that it cannot be disassembled. Further, as described hereinabove, if a different focal length for the socket assembly is desired a different body would be assembled to housing 240 together with a different contact insert and contacts.

While this invention has been described as having a preferred design, it will be understood that it is capable of further modification. Further, while this invention has been described for use in connection with an automobile tail light assembly, it should be understood that it is capable for use with other light assemblies such as automobile turning lights, running lights, etc. This application is therefore intended to cover any variations, uses, or adaptations of the invention following the general principles thereof and including such departures from the present disclosure as come within known or customary practice in the art to which this invention pertains and which fall within the limits of the appended claims.

What is claimed is:

1. A lamp socket assembly comprising:

a housing, said housing including a first cavity;

a body received in said first cavity, said body including a plurality of camming lugs for retaining said lamp socket assembly in a mounted position in an apertured panel, said body further including a through passage for receiving a lamp base therein and means for retaining said lamp base in said through passage;

a contact insert adapted to hold an electrical contact received in said first cavity, said contact insert including a groove for receiving said lamp base therein, said contact insert further including means for receiving and retaining an electrical contact;

an electrical contact retained in said contact insert for electrically engaging a terminal on said lamp base; and a terminal having a first end thereof interlocked with both said contact insert and contact and a second end thereof extending out of said housing in the axial direction of said through passage.

2. The assembly according to claim 1 wherein said terminal includes a U-shaped portion, said first end defining one leg of said U-shaped portion.

3. The assembly according to claim 1 wherein said second end extends at right angles to said first end.

4. The assembly according to claim 1 wherein said terminal includes a U-shaped portion, said first end defining a first leg of said U-shaped portion, said second end extending at right angles to said first end.

5. The assembly according to claim 1 including a socket connector, said housing including a projection thereon, said socket connector including a locking finger and having means for engaging said projection.

6. The assembly according to claim 5 wherein said projection engaging means comprises a slot, said finger including a converging guide path for guiding said slot toward said projection.

7. A socket assembly including a housing, said housing including a first cavity;

a body received in said first cavity and welded to said housing, the body including a plurality of camming lugs for retaining said lamp socket assembly in a mounted position in an apertured panel, said body further including a second cavity for receiving a lamp base therein and means for retaining said lamp base in said second cavity;

a contact received in said body for electrically engaging a terminal on said lamp base; and a terminal having a first end thereof interlocked with said contact, said terminal having a second end thereof extending away from said second cavity in the axial direction of said second cavity.

8. The assembly according to claim 7 wherein said terminal includes a U-shaped portion, said first end defining one leg of said U-shaped portion.

9. The assembly according to claim 7 including a contact insert, said contact insert receiving said contact and adapted to be received in said body.

10. The assembly according to claim 7 including a socket connector, said housing including a projection thereon, said socket connector including a locking finger having means for engaging said projection.

11. The assembly according to claim 10 wherein said projection engaging means comprises a slot, said finger including a converging guide path for guiding said slot toward said projection.

12. The assembly according to claim 7 wherein said first cavity is defined by a bottom wall of said housing and wherein said body is welded to said bottom wall.

13. A lamp socket assembly comprising:

a housing, said housing including a first cavity and a projection;

a body received in said first cavity, said body including a plurality of camming lugs for retaining said lamp socket assembly in a mounted position in an apertured panel, said body further including a through passage for receiving a lamp base therein and means for retaining said lamp base in said through passage;

a contact insert adapted to hold an electrical contact received in said first cavity, said contact insert including a groove for receiving said lamp base therein, said contact insert including means for receiving and retaining a plurality of electrical contacts;

a plurality of electrical contacts adapted to electrically engage a plurality of terminals on said lamp base;

a plurality of terminals interlocked with both said contact insert and respective said contacts; and a socket connector including a locking finger for engaging said projection to lock said socket connector to said housing, said locking finger including guide means for guiding said finger toward said projection.

14. The assembly according to claim 13 wherein said terminal includes a first end for interlocking said terminal with both a said contact and said contact insert and a second end which extends away from said through passage in the axial direction of said through passage.

15. The assembly according to claim 14 wherein each said terminal includes a U-shaped portion, said first end defining one leg of said U-shaped portion.

16. The assembly according to claim 15 wherein said first end of each said terminal extends at a right angle to said second end.

* * * * *